United States Patent [19]

Pennachio

[11] 4,334,686

[45] * Jun. 15, 1982

[54] APPARATUS FOR PLAYING A GAME OF CHANCE

[76] Inventor: Attilo Pennachio, 14 Amber Cir., Las Vegas, Nev. 89106

[ * ] Notice: The portion of the term of this patent subsequent to Nov. 11, 1997, has been disclaimed.

[21] Appl. No.: 205,097

[22] Filed: Nov. 10, 1980

Related U.S. Application Data

[63] Continuation-in-part of Ser. No. 947,630, Oct. 2, 1978, Pat. No. 4,232,866.

[51] Int. Cl.[3] ..... A63B 63/02; A63F 5/02; F41J 5/04

[52] U.S. Cl. ..... 273/374; 273/138 A; 273/274

[58] Field of Search ..... 273/138 A, 371, 398, 273/400, 401, 407, 123 A, 274, 142 R, 142 A, 142 B, 142 C, 142 D, 142 E, 142 F, 374, 1 E, 317, 374, 274; 434/432

[56] References Cited

U.S. PATENT DOCUMENTS

| | | | |
|---|---|---|---|
| 722,359 | 3/1910 | Fowler | 273/138 A |
| 1,892,113 | 12/1932 | Morgan | 273/374 |
| 2,101,658 | 12/1937 | Szabo | 273/317 |
| 2,141,580 | 12/1938 | White | 273/374 |
| 3,366,415 | 1/1968 | Cooper | 434/432 X |
| 3,384,375 | 5/1968 | Zifferblatt | 273/123 A |
| 3,667,757 | 6/1972 | Holmberg | 273/274 |
| 4,036,497 | 7/1977 | Garto et al. | 273/142 E X |
| 4,095,794 | 6/1978 | Garto et al. | 273/142 E X |
| 4,232,866 | 11/1980 | Pennachio | 273/374 |

FOREIGN PATENT DOCUMENTS

| | | | |
|---|---|---|---|
| 468956 | 5/1914 | France | 273/123 A |
| 1050119 | 8/1953 | France | 273/274 |
| 1105682 | 7/1955 | France | 273/274 |
| 949733 | 2/1964 | United Kingdom | 273/274 |

*Primary Examiner*—Richard C. Pinkham
*Assistant Examiner*—Arnold W. Kramer
*Attorney, Agent, or Firm*—Schwartz, Jeffery, Schwaab, Mack, Blumenthal & Koch

[57] ABSTRACT

An apparatus for playing a game of chance which comprises a participator area for accommodating a plurality of players, at least one receptacle within the participator area, a projectile which can be directed by a player from the participator area into the receptacle, and a display. The receptacle defines a plurality of separate recessed regions to each of which is assigned one number or color, and the display has a plurality of display conditions corresponding respectively to the different numbers or colors of the recessed regions. Each region is provided with a switch which is actuated by the projectile when it is in that region to place the electrically interconnected display in the display condition corresponding to that region. Betting layouts are provided for the participants, with each layout containing various options for betting, and the odds or payoff for each option.

10 Claims, 16 Drawing Figures

FIG. 6

| | | | | | | | | | | |
|---|---|---|---|---|---|---|---|---|---|---|
| 30 to 1<br>1-1 | | 30 to 1<br>2-2 | | 30 to 1<br>3-3 | ANY 2 OF KIND<br>4 to 1 | 30 to 1<br>4-4 | | 30 to 1<br>5-5 | | 30 to 1<br>6-6 |
| 30 to 1 | 15 to 1 | 10 to 1 | 7 to 1 | 5 to 1 | 4 to 1 | 5 to 1 | 7 to 1 | 10 to 1 | 15 to 1 | 30 to 1 |
| 2 | 3 | 4 | 5 | 6 | 7 | 8 | 9 | 10 | 11 | 12 |
| LOW GROUP | | | | | | HIGH GROUP | | | | |
| 1 to 1<br>2 · 3 · 4 · 5 · 6 | | | | | | 1 to 1<br>8 · 9 · 10 · 11 · 12 | | | | |

FIG. 7

| | | | | | |
|---|---|---|---|---|---|
| ODD 1 to 1 | | | EVEN 1 to 1 | | |
| 1 | 3 | 5 | 2 | 4 | 6 |
| 4 to 1 | 4 to 1 | 4 to 1 | 4 to 1 | 4 to 1 | 4 to 1 |
| 1 | 2 | 3 | 4 | 5 | 6 |
| LOW 1 to 1 | | | HIGH 1 to 1 | | |
| 1 | 2 | 3 | 4 | 5 | 6 |

FIG. 8

| | | | | | |
|---|---|---|---|---|---|
| DAILY DOUBLE 24 to 1 | | | | | |
| 4 to 1 | 4 to 1 | 4 to 1 | 4 to 1 | 4 to 1 | 4 to 1 |
| RED | BLUE | YELLOW | GREEN | BLACK | WHITE |

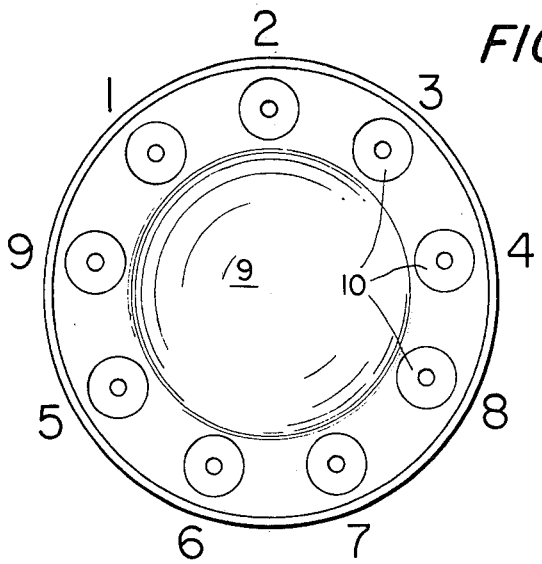
FIG. 10
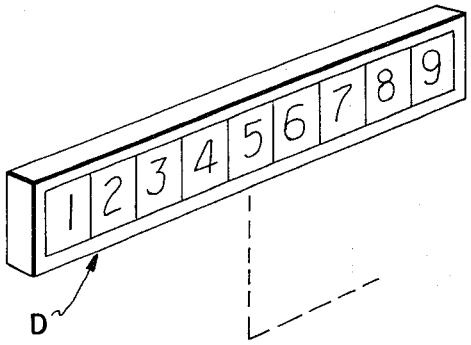
FIG. 11
| 5 to 1 | 5 to 1 | 5 to 1 | 5 to 1 | 5 to 1 | 5 to 1 | 5 to 1 |
|---|---|---|---|---|---|---|
| 1 | 2 | 3 | 4 | 5 | 6 | 7 |
| | | | | | | |
| LOW – 1 to 1 | | | | HIGH – 1 to 1 | | |
| 1 | 2 | 3 | | 5 | 6 | 7 |
FIG. 12
| 7 to 1 | 7 to 1 | 7 to 1 | 7 to 1 | 7 to 1 | 7 to 1 | 7 to 1 | 7 to 1 | 7 to 1 |
|---|---|---|---|---|---|---|---|---|
| 1 | 2 | 3 | 4 | 5 | 6 | 7 | 8 | 9 |
| | | | | | | | | |
| LOW – 1 to 1 | | | | | HIGH – 1 to 1 | | | |
| 1 | 2 | 3 | 4 | | 6 | 7 | 8 | 9 |
FIG. 13

| 10 to 1 | 10 to 1 | 10 to 1 | 10 to 1 | 10 to 1 | 10 to 1 | 10 to 1 | 10 to 1 | 10 to 1 | 10 to 1 | 10 to 1 | 10 to 1 | 10 to 1 |
|---|---|---|---|---|---|---|---|---|---|---|---|---|
| 1 | 2 | 3 | 4 | 5 | 6 | 7 | 8 | 9 | 10 | 11 | 12 | 13 |
| | | | | | | | | | | | | |
| LOW – 1 to 1 | | | | | | | HIGH – 1 to 1 | | | | | |
| 1 | 2 | 3 | 4 | 5 | 6 | | 8 | 9 | 10 | 11 | 12 | 13 |

FIG. 14

| | | | | | | | | |
|---|---|---|---|---|---|---|---|---|
| | ODDS ANY NUMBER (0 – 24) – 20 to 1 | | | | | | | |
| | BLACK – 1 to 1 | | | | RED – 1 to 1 | | | |
| | 3 | 6 | 9 | 12 | 15 | 18 | 21 | 24 |
| 0 | 2 | 5 | 8 | 11 | 14 | 17 | 20 | 23 |
| | 1 | 4 | 7 | 10 | 13 | 16 | 19 | 22 |
| | LOW – 1 to 1 | | | | HIGH – 1 to 1 | | | |
| | ODDS EVEN OR ODD (0 EXCLUDED) 1 to 1 | | | | | | | |

FIG. 15

APPARATUS FOR PLAYING A GAME OF CHANCE

REFERENCE TO RELATED APPLICATION

The present invention is a continuation-in-part of my application Ser. No. 947,630, filed Oct. 2, 1978, now U.S. Pat. No. 4,232,866, granted Nov. 11, 1980.

BACKGROUND AND SUMMARY OF THE INVENTION

This invention relates to games of chance. Games of chance employing one or more dice are well known. However such games are subject to the disadvantage that during play a dishonest player may substitute a loaded die for one which is true and thereby cheat the people with whom he is playing.

According to the present invention, there is provided an apparatus for playing a game of chance comprising a participator area for accommodating one or more players of the game, a receptacle or receptacles spaced from the participator area, a projectile or projectiles which can be directed by such player or players from the participator area into the receptacle(s), and a display. The receptacle defines a plurality of separate regions to each of which is assigned one member of a set of possible play results, and the display has a plurality of display conditions corresponding respectively to the different members of said set, each said region being provided with a detector which is adapted to be actuated by the projectile when the projectile is in that region to place the display in the display condition corresponding to that member of the set of possible results which is assigned to that region.

Any number of regions can be provided, with each such region comprising a recess into which the projectile may drop, at random. There are preferably six or more recesses, with a greater number of recesses affording more combinations of betting opportunities and participation.

BRIEF DESCRIPTION OF THE APPLICATION DRAWINGS

For a better understanding of the invention, and to show how the same may be carried into effect, reference will now be made, by way of example, to the accompanying drawings in which.

Figure 5:
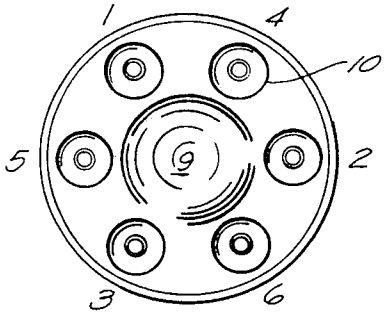
Figure 4:
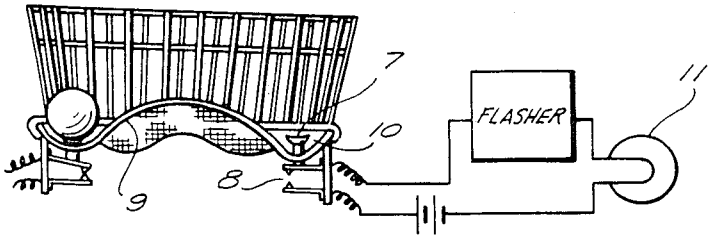
Figure 3A:
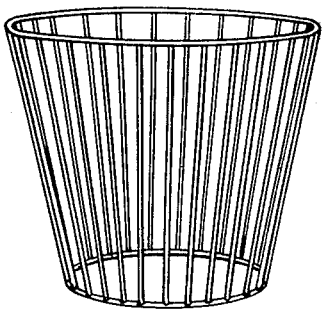
Figure 3B:
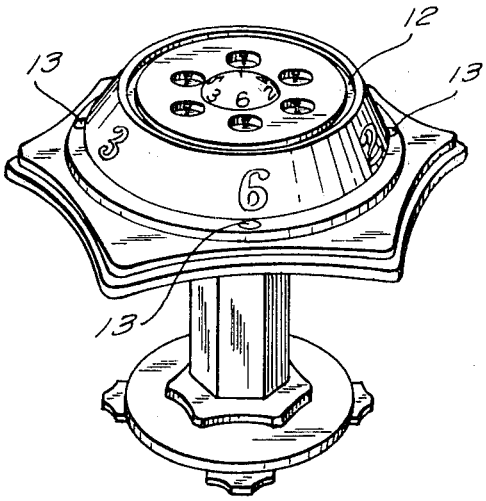

FIGS. 3*a* and 3*b* show perspective views of the two components of the receptacle;

FIG. 4 shows diagrammatically the recesses in the receptacle, and the manner in which the presence of a projectile in a recess functions to actuate the display;

FIG. 5 is a diagrammatic plan view of the receptacle of FIG. 3*b;*

Figure 1:
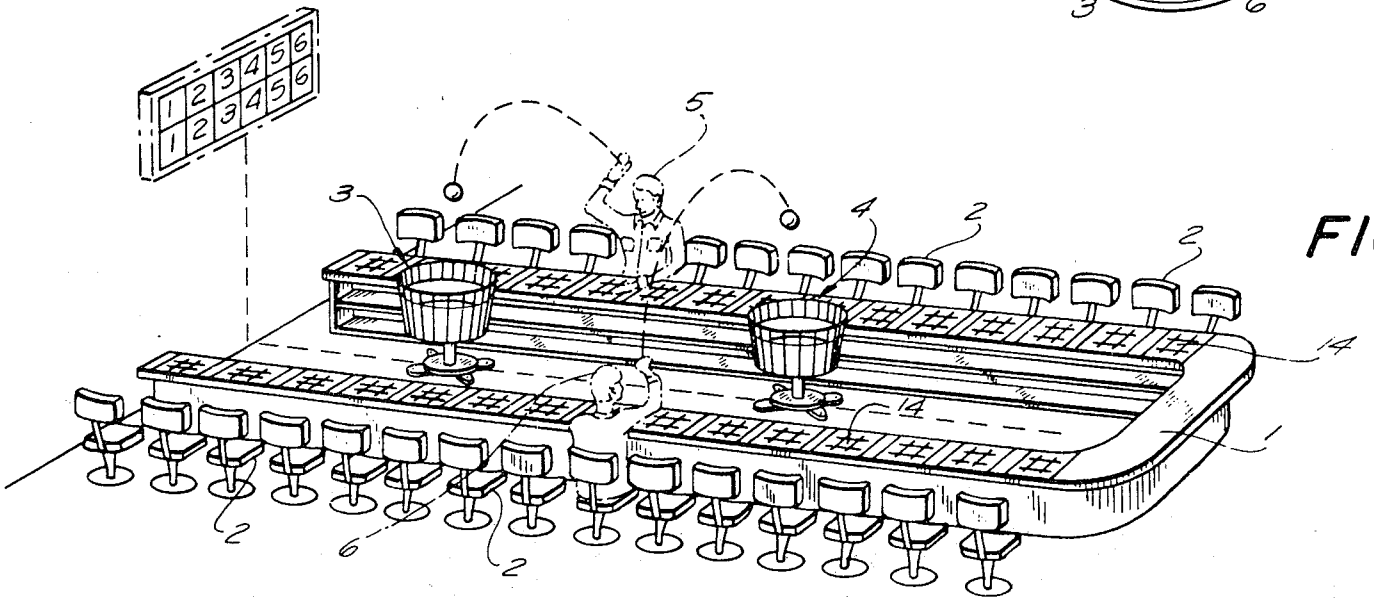
FIG. 1 shows a perspective view of the subject apparatus for playing a first game of chance.
Figure 9:
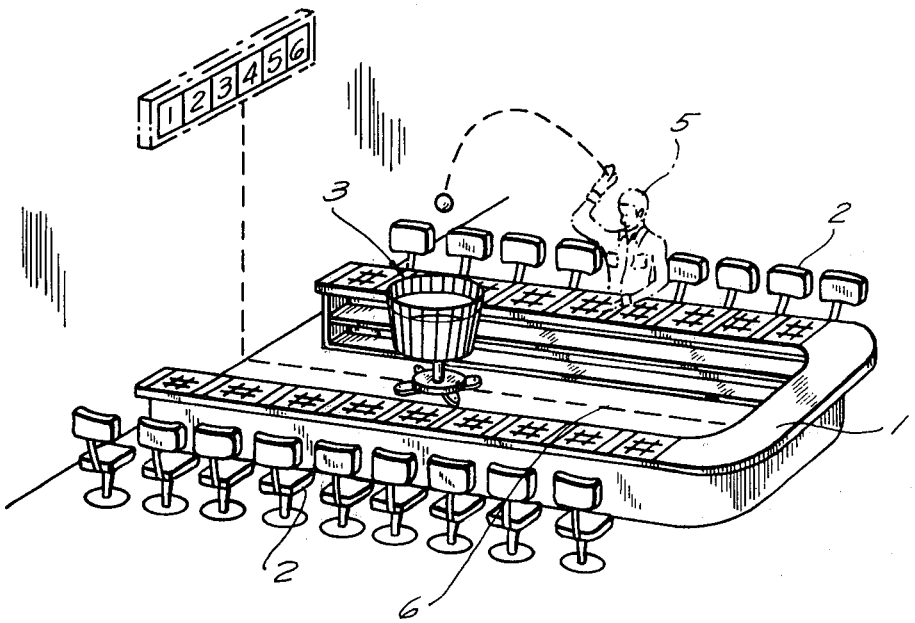

FIG. 6 is a plan view of an individual layout for betting;

FIG. 7 is a plan view of a modified betting layout for playing a second game;

FIG. 8 is a plan view of a further modified betting layout for playing a third game;

FIG. 9 shows a view, similar to FIG. 1, of apparatus for playing the second or third game;

FIG. 10 is a top plan view, similar to FIG. 5, showing a receptacle with nine recesses;

FIG. 11 is a perspective view of a display for the game having the number of recesses as shown in FIG. 10;

FIG. 12 is a betting layout for a game in which seven receptacle recesses are provided;

FIG. 13 is a betting layout for a game in which nine receptacle recesses are provided;

FIG. 14 is a betting layout for a game in which thirteen receptacles are provided, and FIG. 15 is a betting layout for a game in which twenty-five receptacles are provided.

DETAILED DESCRIPTION OF THE PREFERRED EMBODIMENTS

FIG. 1 shows a barrier or counter 1 which separates seats 2 from a pair of receptacle members, in the form of playing baskets or receptacles 3 and 4. Barrier 1 is generally U-shaped in configuration, having a pair of spaced apart, substantially parallel table sections having baskets 3 and 4 disposed therebetween. In accordance with the invention, it is preferred that there be only two actual participators, for example as shown at 5 and 6, the remaining seats being available for occupation by spectators or bettors. Each of the participators is provided with a projectile, typically a rubber ball for throwing into one of the baskets. As a matter of convenience participator 5 throws his ball into the basket 3 while participator 6 throws his ball into the basket 4.

Figure 2:
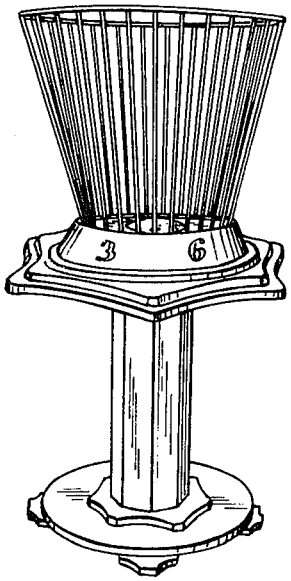
FIG. 2 shows a perspective view of a receptacle.

The construction of the baskets, each of which includes a wall portion and a generally circular base portion, can readily be seen from FIGS. 2, 3*a* and 3*b*. It will be understood that baskets 3 and 4 are identical in construction, with only one basket accordingly being shown in FIGS. 2, 3*a* and 3*b*. Preferably, the wall of each basket is generally frusto-conical in configuration, and is bounded at its lower and upper ends by smaller and larger steel hoops, respectively, which are joined by straight metal rods. The base may be made of wood and the smaller hoop is fitted in a circular groove 12 (FIG. 3*b*) formed in the base adjacent the outer periphery thereof. The base includes a substantially flat outer portion having six equally spaced recesses 10 whose centers lie on a circle which is concentric with the circular groove 12. FIG. 3*b* also shows three bubble spirit levels 13 to ensure that the base is level. The base also includes a central mound portion 9 which is encircled by the recesses 10.

When a ball is thrown into a basket it bounces around therein, rebounding from the steel rods of the basket wall and being deflected by the mound 9, until it finally settles at random into one of the recesses 10. The mound 9 ensures that there is no "dead space" in which a ball thrown into the basket may settle and thus avoid rolling into one of the recesses.

In the bottom of each recess 10 is a switching plunger 7 (FIG. 4) arranged to cooperate with the contacts of a switch 8 to close the switch when a ball is received in that recess. The apparatus also comprises an illuminated display connected to the switches 8. The illuminated display is divided into twelve display areas in two rows of six. Each display area is provided with an electric lamp, for example as shown diagrammatically at 11 in FIG. 4. The six lamps of the upper row are connected respectively with the switches 8 of the basket 3 through respective flasher units while the six lamps of the lower row are similarly connected with the switches 8 of the basket 4. When a ball falls into one of the recesses 10 of the basket 3, the switch 8 associated with that recess is closed and the corresponding display area of the upper row is accordingly illuminated, preferably intermittently. Similarly, when a ball falls into a recess 10 of the basket 4, the switch 8 associated with that recess is closed and the corresponding display area of the lower row is accordingly illuminated intermittently.

In the case of the apparatus shown in FIG. 1, the six display areas respectively associated with the recesses of the basket 3 bear numerals 1 to 6, and the other six display areas are similarly numbered 1 to 6. Thus, the apparatus shown in FIG. 1 may be used to play a game similar to the dice game known as craps, but the two scores shown in the upper and lower rows respectively of the display are selected randomly and there is no possibility as in the dice game of a dishonest player cheating by using loaded dice.

The base of the basket 3 carries six labels adjacent the six recesses 10, and numbered "1" to "6", respectively corresponding to the numbering of the display areas associated with the recesses. The "1" is opposite the "6", the "2" is opposite the "5", and the "3" is opposite the "4". The base of the basket 4 carries relatively larger labels, numbered in a manner corresponding to the numbering of the recesses and the corresponding display areas. The players can readily see through the walls of the baskets and confirm that the numbers shown on the display correspond exactly to the numbers denoted by the labels. Any player or spectator who cannot see directly which recesses the two balls have fallen into can readily ascertain from the flashing display which recesses the balls have in fact fallen into.

For the purpose of gambling on the results of the game played with the apparatus shown in FIG. 1, there is provided on the barrier 1 in front of each seat 2 of a staking plan or layout 14 as shown in FIG. 6. In a typical game, the house may offer odds of 30 to 1 against the two scores having a selected equal value, and odds of 4 to 1 against the two scores having any equal value. The odds offered against any particular sum of the two scores may be between 4 to 1 (sum of 7) and 30 to 1 (sum of 2 or 12). For a sum anywhere in the range 2 to 6 or 8 to 12, the house may offer odds of 1 to 1. Each player places his chips on the region of his layout corresponding to the bet he wishes to make.

It will be clear that the layout shown in FIG. 6 provides four possible ways of winning in the case that the two scores have an equal value, two possible ways of winning if the sum of the scores is not 7, even if the scores do not have an equal value, and one way of winning if the sum of the scores is 7. The number and variety of options is very popular with the gambling public.

The second game is similar to that played with the apparatus shown in FIG. 1, except that only one basket, one ball and one row of illuminated display areas are used, as shown in FIG. 9, and this second game is similar to throwing a single die. The odds offered by the house against a particular result occurring may be in accordance with the layout shown in FIG. 7.

The third game is a modification of the second game whereby instead of numerical scores the result of each play is expressed in terms of color, with each recess being given a color rather than a number. Referring to FIG. 8, there are 12 zones each of which denotes a manner of winning and the payoff for the respective manner of winning. More particularly, it will be noted that the 12 zones depicted in FIG. 8 are broken down into two groups. The first group comprises six zones, one for each of a different color, typically red, blue, yellow, green, black and white. Each zone in said first group denotes predetermined payoff odds, such as 4 to 1, relating to the directing of the ball into one of the basket recesses associated with a particular color. The second group of zones labeled "Daily Double" in FIG. 8 comprises six zones, one for each of the above described colors. Each of the zones in the second group of zones denotes predetermined payoff odds (e.g. 24 to 1) relating to a successive first and second directing of the ball into one of the basket recesses, the payoff odds of the second group of zones being greater than that of said first group. For example, a player may place a bet on the red zone in the first group. If the ball tossed to the basket settles in the recess associated with the color red, the player gets back an initial amount of $5.00 (assuming a bet of $1.00), the odds in the first group of zones having been set at 4 to 1. If the player wishes to bet the "Daily Double", he then must place his $5.00 in the red zone of the second group (i.e. the area in the Daily Double zone disposed immediately above the red zone in the first group of zones) wherein if upon a second successive toss to the basket the ball again settles into the recess associated with the color red, the player receives $25.00 back where the odds for the second group of zones has been set at 24 to 1.

It will be noted that all of the embodiments of the invention are used in conjunction with a group game in which many people may play at one time. However, there is only one decision or result effected for each play. It will be further noted that in the embodiment of the subject invention wherein two baskets are included, one player does not toss both balls, unless he is the only player.

The forms of the invention above described are base on either one or two receptacles each having six recesses, with each recess being either numbered or colored. Although two separate receptacles are employed in the FIG. 1 form of the invention, each has six recesses, with the associated play comprising two rows of six numbers each. It is possible, in accordance with the invention, to provide the receptacle with fewer or more recesses than six, and FIGS. 10–15 disclose modifications of the invention in which more than six recesses are provided. In each modification, only a single receptacle is provided, along with a corresponding display, although it will be understood that two or more receptacles and corresponding displays can be used as well. Although the about to be described betting layouts are based on a single receptacle and corresponding display, it will be noted that the displays can be integrated in a betting scheme of the type illustrated in FIG. 6 and described above.

Referring to FIGS. 10, 11 and 13, the receptacle is shown with nine (9) recesses commonly designated at 10, preferably spaced equally circumferentially around the receptacle in the same manner as previously described and as shown in FIGS. 1 and 3*b*. The receptacle and basket are preferably of the same construction as previously described, with the receptacle in the central region thereof being provided with a mound 9 which facilitates the movement of the projectile randomly into one of the nine recesses. The basket is not illustrated in FIG. 10, but is preferably of the same construction and can be retained in place by means of groove 12 formed in the base, as shown in FIGS. 2 and 3*b*. Likewise, the switching arrangement for displaying the number of the recess into which projectile falls is preferably of the same arrangement as FIG. 4, including the display and flasher, with the display being shown at D in FIG. 11. It will be seen that the display D contains 9 numbers, corresponding to the nine recesses in the base, as shown in FIG. 10.

The betting layout for the FIG. 10 form of the invention is shown in FIG. 13, and illustrates one betting scheme. The payoff odds for the ball or projectile randomly dropping into one of the nine specified recesses is 7 to 1, and the bettor is also able to bet on low numbers 1–4 or high numbers 6–9. The odds when betting low or high are 1 to 1, with 5 being a "house" number, that is, when the ball falls into the recess numbered 5, there is no winner on the low or high bets. It will be understood that additional betting schemes could also be employed, for example, odd or even, and a coloring scheme could also be used for each recess or groups of recesses. In addition, two receptacles could be employed and a duplicate display board of the type shown in FIG. 11 utilized, thereby greatly expanding the variation in the betting layout.

Referring to FIG. 12, there is illustrated therein a betting layout for a receptacle base in which 7 recesses are formed. If a bettor places a bet on any one number, the winning odds are 5 to 1, with the odds being 1 to 1 on the low numbers 1–3 or the high numbers 5–7. Similarly, the middle number 4 is a "house" number when betting the high or low group. It will be understood, however, that 4 can be a selected winner in the event individual numbers are selected as shown at the top of FIG. 12. These same comments apply with respect to the FIG. 13 layout, where 5 can likewise be a winning number where a single specific number is selected.

Referring to FIG. 14, there is illustrated therein a further form of the invention in which the receptacle base is provided with 13 arcuately spaced openings. A corresponding display D likewise will be provided with 13 numbers. The betting scheme as shown in FIG. 14 includes a 10 to 1 payout on any particular number selected, with a bet on the low numbers 1–6 and/or the high numbers 8–13 paying out at 1 to 1. The "house" number when betting high or low is 7, the occurrence of which will preclude payout on any high or low bets that may have been made. Again, two receptacles and corresponding displays could be provided, thereby greatly expanding the potential betting combinations. Colors could also be substituted for or used in combination with the numbers appearing on the display.

FIG. 15 illustrates yet another game in which 25 recesses are provided in the receptacle base. Although such recesses are preferably equally spaced circumferentially around the base, as shown in previous figures, it will be understood that the base may be required to be larger in diameter to accommodate such recesses. The FIG. 15 game is intended to simulate the game of roulette, with the throwing of the ball or projectile into a recess, at random, replacing the roulette wheel.

FIG. 15 shows the more common betting combinations that can be made with this modification. At the top of the betting layout, there is indicated the odds (20 to 1) on the selection of any particular number, including zero (0) which appears at the left of the betting layout, and which also appears on the display. As shown, the numbers 1–12 are preferably colored black, and the numbers 13–24 are preferably colored red. The group of numbers 1–12 also comprise the low grouping, and the numbers 13–24 comprise the high group of numbers. The odds when selecting either black or red, or high or low, are 1 to 1, with the "house" number being zero (0). The layout also includes provision for betting even or odd numbers, with zero being excluded, with the odds being 1 to 1, as with selecting a color or a high or low group of numbers. The game illustrated in FIG. 15 thus is comparable in essential respects to the game of roulette, except that the payout number is a result of throwing the ball or projectile into the receptacle, thereby adding a degree of excitement and uncertainty during the playing of the game.

In addition to the unique aspect of random number selection through the ball and recess arrangement, all of the above described games have the important advantage of being relatively tamper-proof, a very important consideration for the betting public. The ball or projectile is thrown by a participant into one or more receptacles, with the ball falling by random into one of the recesses spaced equally around the base of the receptacle. In the FIGS. 10–15 forms of the invention, as in the forms previously described, the base is provided with leveling means, reference being made to bubble spirit level 13 as shown in FIG. 3*b*, to make certain that the receptacle base is level at all times. These levels are at the exterior of the receptacle and in plain view of those participating and betting, thereby ensuring that the dropping of the ball into a particular recess is entirely at random. In dice games, on the other hand, there is always the possibility of playing with imperfect dice, and a roulette wheel, referring to the FIG. 15 form of the invention, might also be susceptible to imperfect rotation.

Although the recesses and displays as illustrated and described are either numbered or colored, it will be apparent that other symbols could also be utilized. For example, in the FIG. 13 form of the invention, the numbers 1–6 and 8–13 could be replaced by the signs of the zodiac, with corresponding signs being provided in the display. The seventh recess could be a different symbol, which would also appear in the proper sequence on the display, and in the first line of the betting layout. Such different symbol would be the "house" symbol in the high or low betting groups, replacing 7 in the FIG. 13 layouts.

I claim:

1. A gambling apparatus comprising a generally U-shaped table member having a pair of spaced apart substantially parallel table sections and a plurality of seats disposed along the outside portions of said sections for accommodating numerous participators; receptacle means disposed between said table sections, said receptacle means including a basket and a generally circular base member, said base member having formed therein seven or more equally spaced circular recesses, the centers of said recesses defining a circle concentric with the periphery of the base member, said base member further including a central closed mound encircled by said recesses, each of the recesses being associated with a number from 1 to a number corresponding to the total number of recesses, each of said numbers being indicated on the outside of the receptacle adjacent its associated recess, each of said numbers being further indicated on said mound portion adjacent its respective associated recess; a ball which may be directed by one of said participators to said receptacle for randomly falling into one of said recesses; means for leveling said base member to ensure the completely random entry of said ball into one of said recesses; visual display means for displaying each and all of said numbers corresponding to said recesses; electrical control means associated with each recess for communicating the presence of the ball in such recess to said display means for displaying the number corresponding to the respective ball containing recess; and a plurality of individual betting layouts disposed on said table sections, each of said layouts including a plurality of separate betting zones each of which denotes a manner of winning and the payoff for the respective manner of winning, said betting zones including zones for each number and various groups or combinations of numbers.

2. The gambling apparatus of claim 1 wherein the upper surface of said base member is formed with an annular groove, said basket being generally frustroconical and having an annular bottom portion which releasably fits into said groove for retaining said basket on said base.

3. The gambling apparatus of claim 1 wherein said basket is frustroconical in shape and is formed by upper and lower ends in the form of metal hoops, and metal rods extending between said hoops, said metal rods being spaced from each other so that the participators can visually detect the movement of the ball downwardly in the basket and around the area encircling the central mound before randomly dropping into one of said recesses.

4. The gambling apparatus of claim 1 wherein said electrical control means associated with each recess comprises a switch which includes a plunger extending through an opening in the bottom of said recess, said plunger carrying at its bottom a contact adapted to engage a second, spaced contact when said ball falls into the recess and depresses the switch plunger, said contacts being connected to said display means.

5. The gambling apparatus of claim 1 wherein seven recesses are formed in said base member, with said recesses being numbered 1 to 7, respectively, and said display means correspondingly comprising a display of the numbers 1 to 7, with each of said betting layouts including betting zones which denote a manner of winning when a particular number is selected, or a combination of such numbers.

6. The gambling apparatus of claim 1 wherein nine recesses are formed in said base member, numbered 1 to 9, respectively, and said display means contains said numbers 1 to 9, each of said betting layouts including separate betting zones denoting the manner and odds of winning when a single predetermined number is selected, or combinations of numbers.

7. The gambling apparatus of claim 1 wherein 13 recesses are formed in said base member, numbered 1 to 13, respectively, and said display means contains said numbers 1 to 13, respectively, with each betting layout including a plurality of betting zones denoting a manner and odds of winning when a particular number is selected, or when groups of numbers are selected.

8. The gambling apparatus of claim 1 wherein 25 recesses are formed in said base member, numbered 1 to 25, respectively, and said display means contains said numbers 1 to 25, respectively, with each betting layout including separate betting zones denoting a manner and odds of winning when a particular number or groups of numbers are selected, with said betting layout additionally including a group of numbers designated by a first color, and a second group of numbers designated by a second color, thereby permitting participants to place bets based on color or a specific number or groups of numbers.

9. The gambling apparatus of claim 1 wherein an odd number of seven or more recesses are formed in said base member, with said display means displaying numbers corresponding to said recesses, with each betting layout including separate betting zones each of which denotes the manner and odds of winning when a particular number or groups of numbers are selected, with any number when selected from said total number of numbers paying off in specified odds, and a designated number being not included in the payoff where combinations of numbers are selected.

10. A gambling apparatus comprising a generally U-shaped table member having a pair of spaced apart substantially parallel table sections and a plurality of seats disposed along the outside portions of said sections for accommodating numerous participators; receptacle means disposed between said table sections, said receptacle means including a basket and a generally circular base member, said base member having formed thirteen equally spaced circular recesses, the centers of said recesses defining a circle concentric with the periphery of the base member, said base member further including a central closed mound encircled by said recesses, each of the recesses being associated with a symbol different from the symbols associated with the other recesses, each of said symbols being indicated on the outside of the receptacle adjacent its associated recess, and being further indicated on said mound portion adjacent its respective associated recess; a ball which may be directed by one of said participators to said receptacle for randomly falling into one of said recesses; means for leveling said base member to ensure the completely random entry of said ball into one of said recesses; display means having symbols corresponding to said recesses; electrical control means associated with each recess for communicating the presence of the ball in such recess to said display means for displaying the symbol corresponding to the respective ball containing recess; and a plurality of individual betting layouts disposed on said table sections, each of said layouts including a plurality of separate betting zones each of which denotes a manner of winning and the payoff for the respective manner of winning, said betting zones including zones for each symbol or groups or combinations of symbols.

* * * * *